US008259031B2

(12) United States Patent
Chen

(10) Patent No.: US 8,259,031 B2
(45) Date of Patent: Sep. 4, 2012

(54) ANTENNA STRUCTURE

(75) Inventor: Ralph Chen, Hsin Tien (TW)

(73) Assignee: Grand-Tek Technology Co., Ltd., Taipei Hsien (TW)

( * ) Notice: Subject to any disclaimer, the term of this patent is extended or adjusted under 35 U.S.C. 154(b) by 112 days.

(21) Appl. No.: 12/472,483

(22) Filed: May 27, 2009

(65) Prior Publication Data

US 2010/0302124 A1 Dec. 2, 2010

(51) Int. Cl.
*H01Q 1/42* (2006.01)

(52) U.S. Cl. ..... 343/906

(58) Field of Classification Search ..... 343/906, 343/872, 702, 900

See application file for complete search history.

(56) References Cited

U.S. PATENT DOCUMENTS 5,621,420 A * 4/1997 Benson ..... 343/791
6,057,804 A * 5/2000 Kaegebein ..... 343/792
6,480,168 B1 * 11/2002 Lam et al. ..... 343/805
6,552,692 B1 * 4/2003 Zeilinger et al. ..... 343/792
7,327,325 B2 * 2/2008 Schadler ..... 343/792

* cited by examiner

*Primary Examiner* — Huedung Mancuso

(74) *Attorney, Agent, or Firm* — Chun-Ming Shih; HDLS IPR Services

(57) ABSTRACT

This invention provides an improved antenna structure comprising a connecting unit having a connector, a lightning rod, and a signal transmission section. The two ends of the connector has the first and second connecting sections, with the signal transmission section extending out the first and second connecting sections; and a connecting unit connecting to the antenna unit, which contains at least an antenna board fixed to the first connecting section and the signal transmission section, and a set of housing installed at the outer section of the antenna board and connecting to the connector. Through this, the lightning rod, connecting unit, and antenna unit can be integrated together and the effectiveness of simple structure, ease to assemble, and lowered manufacturing cost can be achieved.

2 Claims, 6 Drawing Sheets

ANTENNA STRUCTURE

BACKGROUND OF THE INVENTION

1. Field of the Invention

The present invention is about an improved antenna structure, particularly an antenna unit integrated with a lightning rod and a connecting unit in order to achieve the effectiveness of simple structure, ease in assembly, and low manufacturing cost.

2. Description of the Prior Arts

The conventional antenna structure (illustrated in FIG. 6) comprise of an antenna main body 4 and a lightning rod unit 5, wherein the antenna main body 4 is installed with an antenna board 41, a connector 42 connecting to the antenna board 41, and a housing 43 installed outside the antenna board 41 and connecting to connector 42. The lightning rod 5 is connected to the connector 42 of the antenna main body 4. When in use, the lightning rod 5 is connected to the connecting end 61 of the outdoor transmitting/receiving equipment 6, then one end of the connector 42 on the antenna main body 4 is connected to lightning rod 5 wherein the antenna main body 4 is used for the transmission/reception of radio signal for the outdoor transmitting/receiving equipment 6 while achieving lightning avoiding effect for outdoor use together with lightning rod 5.

Although the conventional antenna main body 4 stated above together with lightning rod 5 could enable the outdoor transmitting/receiving equipment 6 to achieve the effect of radio transmission and avoiding lightning, the structure of the antenna main body 4 is more complicated because the antenna main body 4 is composed of the antenna board 41, connector 42, and housing 43. Also, the antenna main body 4 must be used together with the lightning rod 5 to achieve the lightning avoiding effect stated above, the structure is more complicated in actual use and higher in manufacturing cost.

In view of this, how to create an improved antenna structure for integrating lightning rod, connecting unit, and antenna unit and achieve the effectiveness of simple in structure, ease in assembly, and lowering manufacturing cost is what the present invention attempts to reveal.

SUMMARY OF THE INVENTION

In view of the problems of conventional antenna structure stated above, the inventor has put in effort and developed an improved antenna structure through the experience accumulated over the years in the industry in anticipation of integrating the lightning rod, connecting unit, and antenna unit to achieve the effectiveness of simple in structure, ease in assembly, and lowering of manufacturing cost.

The main purpose of the present invention is to provide an improved antenna structure through the integration of lightning rod, connecting unit, and antenna unit so that the connecting unit has the effect of avoiding lightning and further achieves the effectiveness of simple in structure, ease in assembly, and lowering of manufacturing cost.

To achieve the above stated purpose, the improved antenna structure of the present invention includes a connecting unit having a connector, a lightning rod, and a connecting unit of signal transmitting section. The two ends of the connector have the first and second connecting sections respectively, and the signal transmitting section has extended first and second connecting sections, and an antenna unit connecting to the connecting unit, which at least includes an antenna board fixed to the first connecting section and connecting to the signal transmitting section, and a set of housing installed outside the antenna board and connecting to the connector.

Through this, an improved antenna structure of the present invention integrates the lightning rod, connecting unit, and antenna unit to achieve the effectiveness of simple in structure, ease in assembly, and lowering of manufacturing cost.

DETAILED DESCRIPTION OF THE PREFERRED EMBODIMENTS

Figure 1:
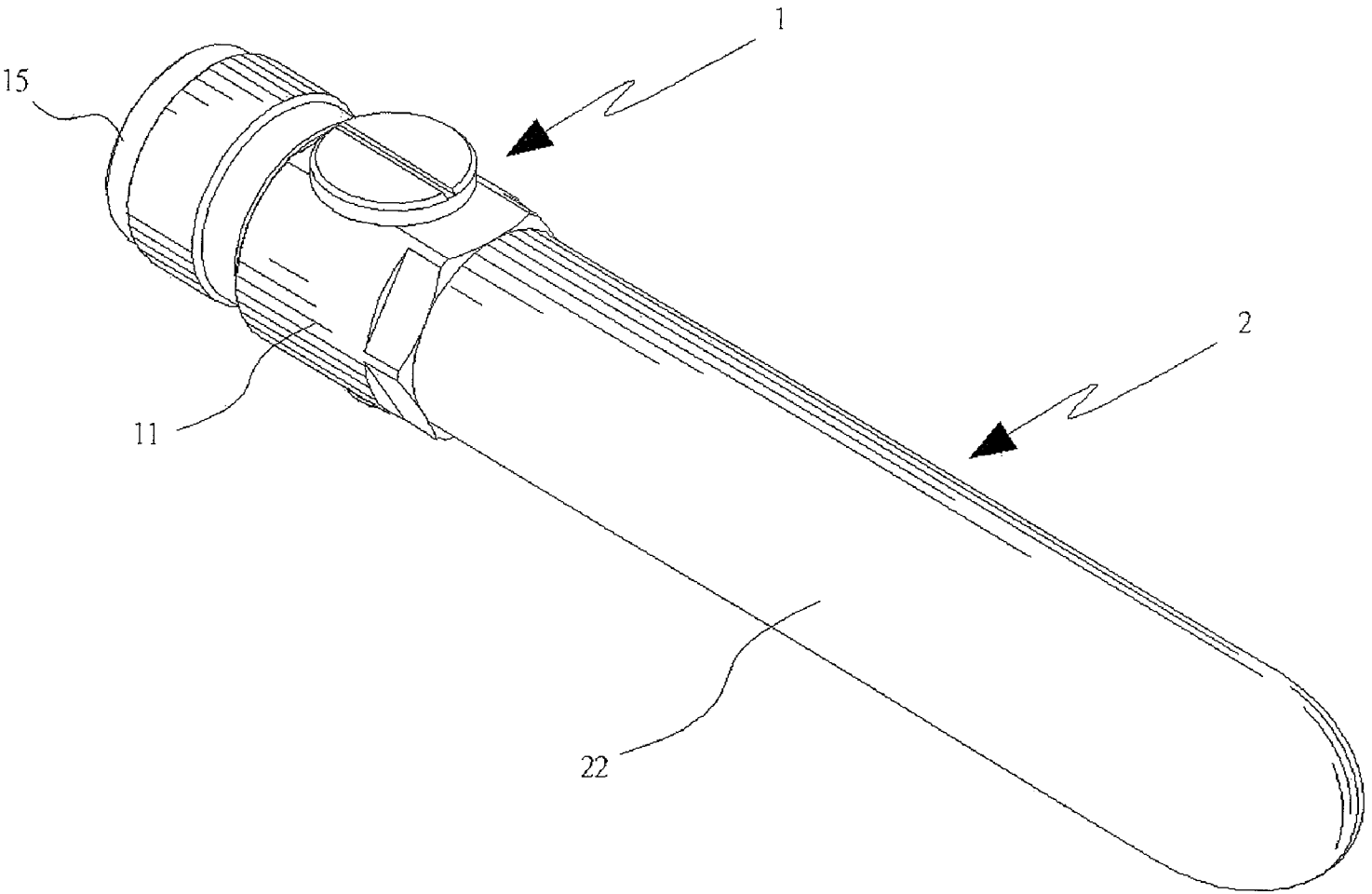
FIG. 1 is the illustration of the 3D outlook of the present invention.
Figure 2:
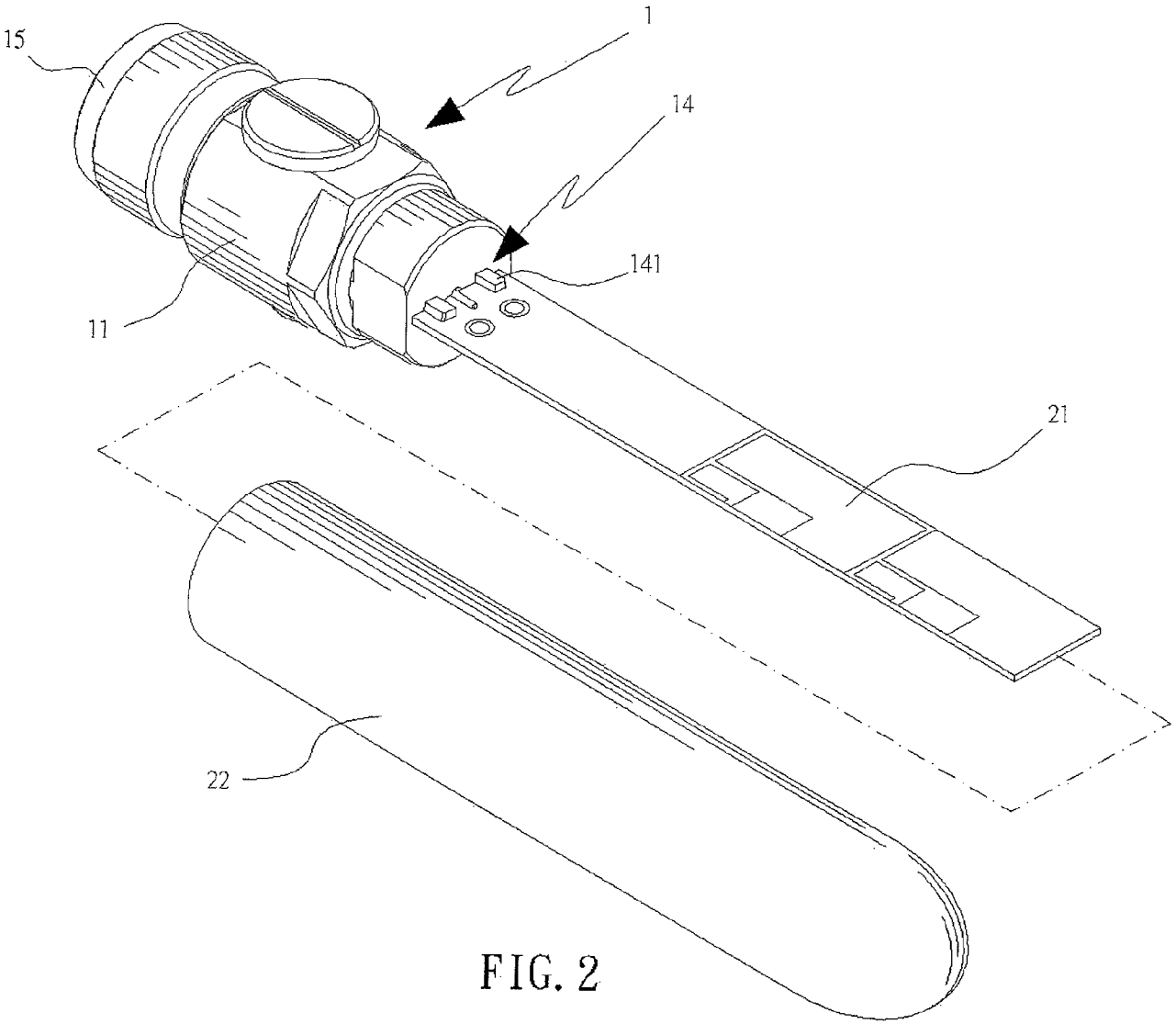
FIG. 2 is the 3D exploded illustration of the present invention.
Figure 3:
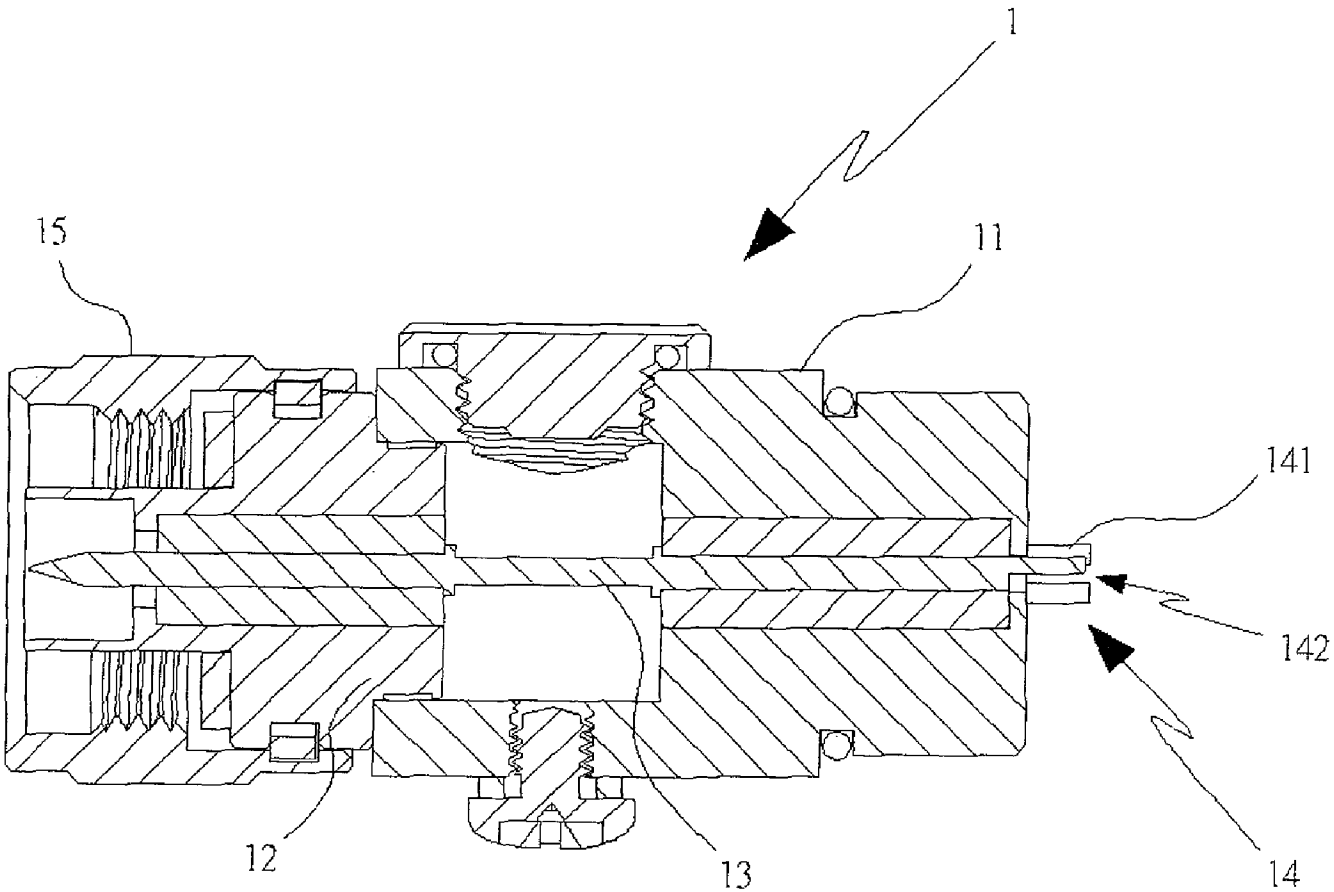
FIG. 3 is the cross-sectional diagram of the connecting unit of the present invention.
Figure 4:
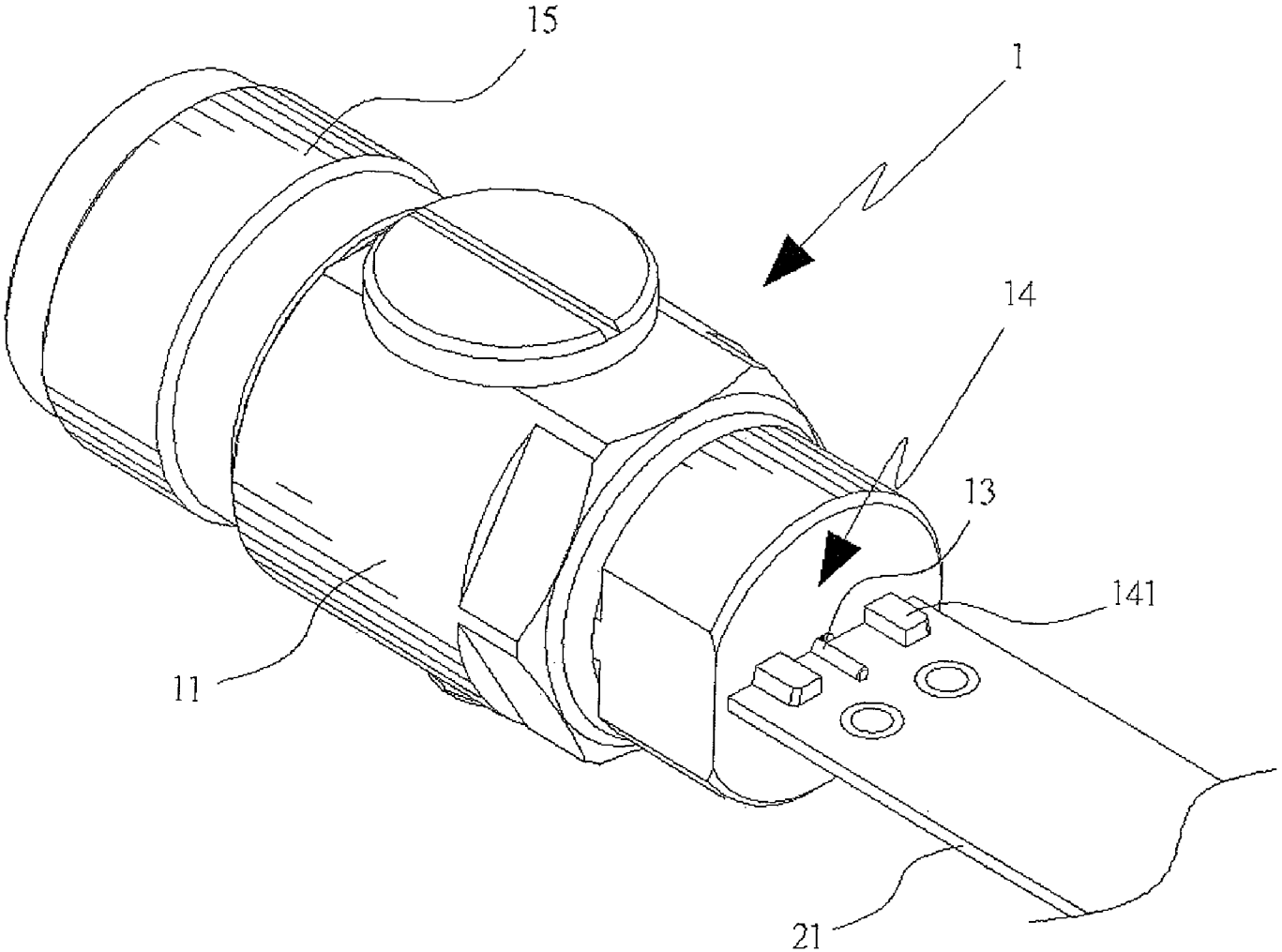
FIG. 4 is the connecting state illustration of the connecting unit and the antenna board.
Figure 5:
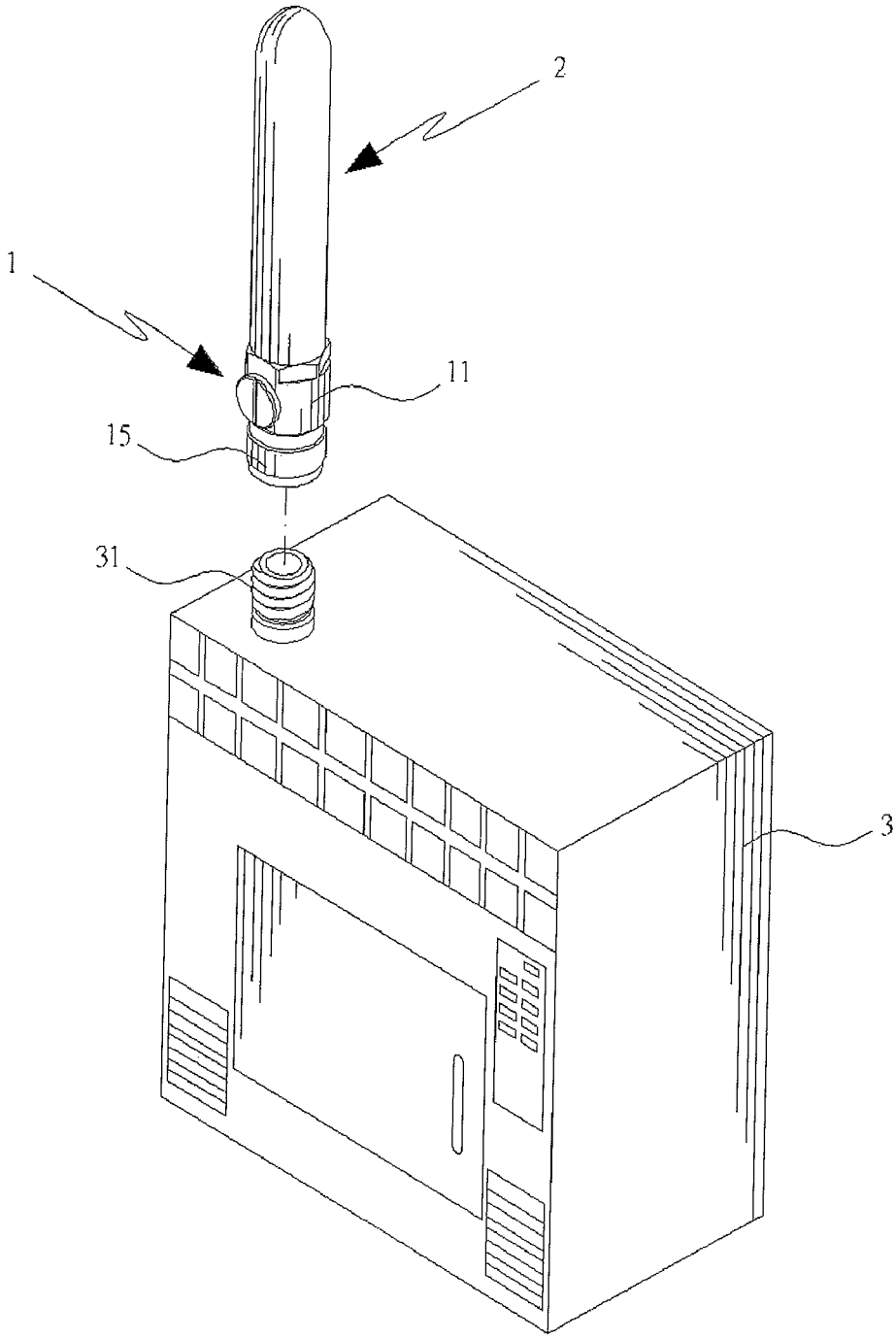
FIG. 5 is the illustration of the state of using of the present invention.
Figure 6:
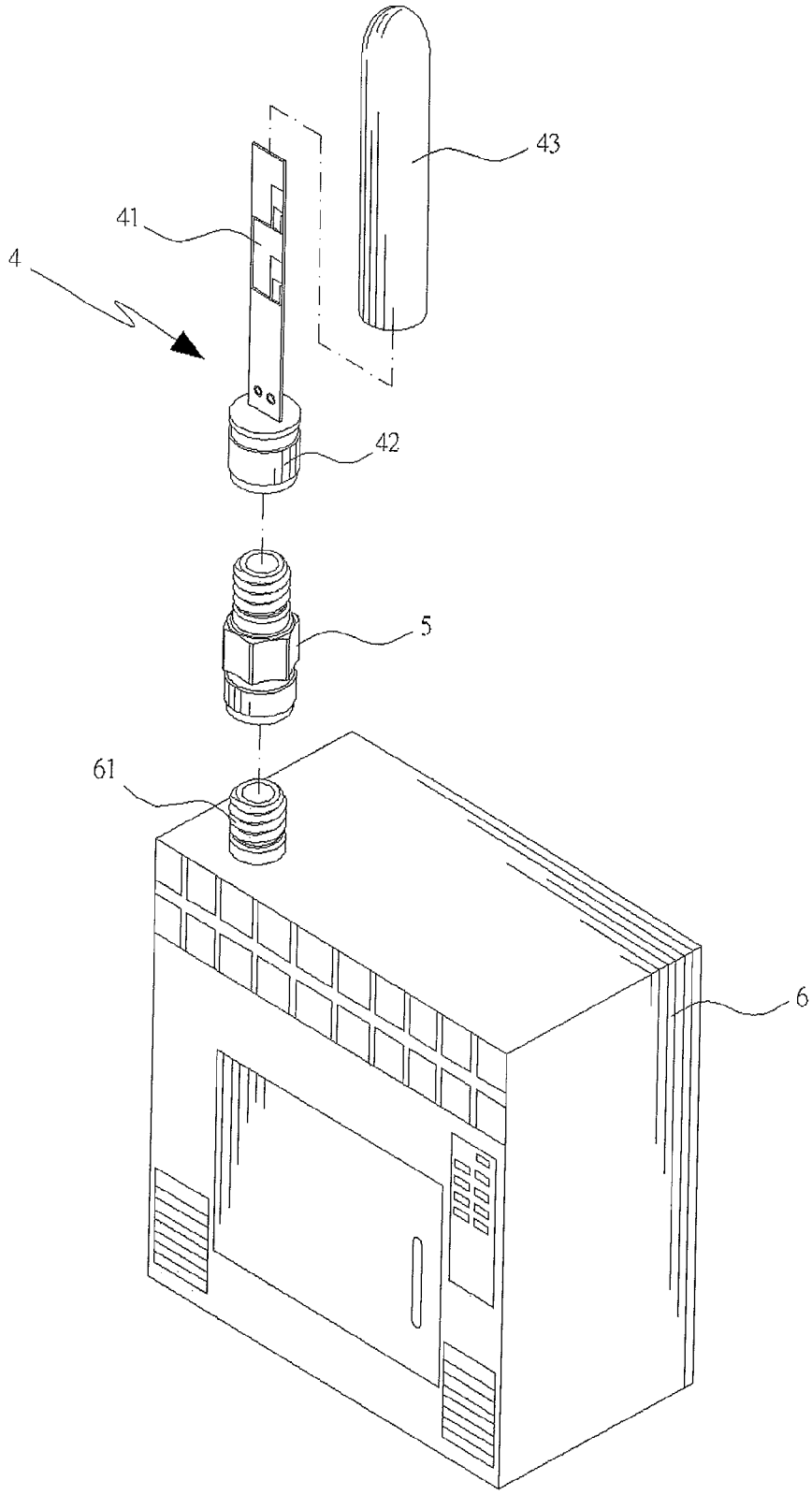
FIG. 6 (prior art)
FIG. 6 is the state of using of prior art.

To thoroughly understand the purpose, feature and effectiveness of the present invention, the present invention is described in detail through the preferred embodiment below together with attached illustrations as below:

Please refer to diagrams 1, 2, 3, 4, and 5, wherein the 3D outlook of the present invention, the 3D exploded illustration of the present invention, the cross-sectional diagram of the connecting unit of the present invention, and diagram of connecting state of the connecting unit and antenna board of the present invention are shown. As shown in the diagrams, the improved antenna structure of the present invention is formed by at least a connecting unit 1 and an antenna unit 2.

The connecting unit 1 stated above contains at least a connector 11, a lightning rod 12 installed in the connector 11, and a signal transmitting section 13 connecting with lightning rod 12. The two ends of the connector 11 has the first and second connecting sections 14 and 15 respectively, wherein the first connecting section 14 contains many bumps 141, with grooves 142 forming between the corresponding bumps. The second connecting section 15 is a screw slot, and the signal transmitting section 13 extends from the first and second connecting sections 14 and 15.

The antenna unit 2 is connected to connecting unit 1, containing at least an antenna board 21 and a housing 22. The antenna board 21 is held and fixed between grooves 142 formed between each of the bumps 141, and the antenna board 21 is connected to the signal transmitting section 13 through soldering so that the antenna board 21 can be used as grounding through the bumps 141. The housing 22 is slotted on the outside of the antenna board 21 and connected to the connector 11.

When the present invention is in use, the second connecting section 15 of the connecting unit 1 is connected to the connector end 31 of the outdoor transmitting/receiving equipment 3, so that the antenna unit 2 is used for the transmission of radio signal of outdoor transmitting/receiving equipment 3 and at the same time the lightning rod 12 in the connecting unit 1 is used to achieve lightning protection when used outdoor. As the present invention is to integrate the lightning rod 12, the connecting unit 1, and the antenna unit 2, it indeed could achieve the effectiveness of simple in structure, ease in assembly, and lowering of manufacturing cost.

As stated above, the present invention meets the three criteria of patent, i.e. innovation, advancement, and industrial availability. In terms of innovation and advancement, the present invention integrates the lightning rod, connecting unit, and antenna unit to achieve the result of simple in structure, ease in assembly, and lowering of manufacturing cost. In terms of industrial availability, products derived from the present invention surely meets the current market need.

The present invention has been revealed through a preferred embodiment. However, experts professed in such technology should realize the preferred embodiment only applies to the present invention and should not be interpreted as limitation to the range of the present invention. It should be noticed that all variations and changes equivalent to the present invention should be within the range of the present invention. Hence, the range of protection of the present invention should be delimited based on the claim listed below.

What is claimed is:

1. An antenna structure comprising:

an integrated one-piece connecting unit, including a connector with two ends formed as a first and a second connecting sections, respectively, a lightning rod installed in the connector and located between the first and the second sections, and a signal transmitting section connecting with lightning rod and extended from the second connecting section to the first connecting section to protrude out of the first connecting section;

at least one pair of bumps formed on the surface of the first connecting section, a groove being formed in between the pair of the bumps; and an antenna unit, connecting to the connecting unit, containing at least an antenna board fixed to the first connecting section to be held by the pair of bumps in the groove and connecting to the signal transmitting section, and a housing installed on the outside of the antenna board and connecting to the connector.

2. An antenna structure as claim 1, wherein the second connecting section includes a screwed housing and the signal transmitting section is protruded out of the second connecting section within the screwed housing.

* * * * *